United States Patent [19]

Hamacher

[11] 4,423,474

[45] Dec. 27, 1983

[54] MINE LAMP

[76] Inventor: Martin Hamacher, Westerholter Str. 791, 4352 Herten, Fed. Rep. of Germany

[21] Appl. No.: 238,421

[22] Filed: Feb. 26, 1981

[30] Foreign Application Priority Data

Mar. 1, 1980 [DE] Fed. Rep. of Germany ..... 3007972

[51] Int. Cl.[3] ..... F21S 3/00; F21V 15/00; F21V 17/00

[52] U.S. Cl. ..... 362/223; 362/260; 362/267; 362/368; 362/374; 362/390; 362/455

[58] Field of Search ..... 362/84, 260, 158, 164, 362/217, 223, 224, 225, 267, 368, 369, 374, 375, 390, 61, 80, 83, 455, 72, 365

[56] References Cited

U.S. PATENT DOCUMENTS

| | | | |
|---|---|---|---|
| 2,606,772 | 8/1952 | Mead et al. | 362/80 X |
| 2,694,775 | 11/1954 | Florence | 362/222 |
| 2,993,115 | 7/1961 | Rosenblatt | 362/223 |
| 3,049,613 | 8/1962 | Baldwin | 362/267 |
| 3,187,171 | 6/1965 | Trautner et al. | 362/267 X |
| 3,222,512 | 12/1965 | Dickson | 362/390 X |
| 3,309,644 | 3/1967 | Zubko | 362/80 X |
| 3,780,282 | 12/1973 | Riley et al. | 362/267 |
| 3,941,994 | 3/1976 | Petty et al. | 362/83 |
| 4,118,767 | 10/1978 | Urbanek | 362/267 X |
| 4,138,716 | 2/1979 | Muhlethaler et al. | 362/267 X |
| 4,141,061 | 2/1979 | Ford et al. | 362/260 X |
| 4,163,275 | 7/1979 | Weber et al. | 362/80 |
| 4,282,564 | 8/1981 | McJunkin et al. | 362/164 X |

FOREIGN PATENT DOCUMENTS

| | | | |
|---|---|---|---|
| 636316 | 2/1962 | Canada | 362/223 |
| 1119731 | 4/1956 | France | 362/223 |
| 1378061 | 10/1964 | France | 362/223 |
| 1547192 | 10/1968 | France | 362/223 |

*Primary Examiner*—David H. Brown

*Attorney, Agent, or Firm*—Karl F. Ross; Herbert Dubno

[57] ABSTRACT

A mine lamp has a support to which is releasably secured a flat base plate having a stepped outer edge and a forwardly directed face. This outer edge is formed with an annular abutment surface lying in a plane generally parallel to and offset backwardly from the face and an annular outwardly directed guide surface inclined at an angle to the abutment surface. A light tube is releasably supported on the base plate within the edge and in front of the face. A concave, at least partially transparent, and at least limitedly elastically deformable cover has an end wall generally parallel to and offset forwardly of the face and a continuous annular side wall extending backwardly from the end wall and having an annular rear edge formed with an annular and generally planar surface engaging backwardly against the abutment surface and an annular retaining surface engaging inwardly against the guide surface. Interengaging formations on the retaining and guide surfaces elastically retain the cover in place on the base plate with the rear edge in annular all-around contact with the outer edge.

12 Claims, 4 Drawing Figures

MINE LAMP

FIELD OF THE INVENTION

The present invention relates to a lamp using a bulb of the cold-cathode type. More particularly this invention concerns a mine lamp having a fluorescent or other cold-cathode light source.

BACKGROUND OF THE INVENTION

It is standard practice, as for example seen from my earlier U.S. Pat. No. 4,186,432 and patent application Ser. No. 084,194 filed Oct. 12, 1979 (now U.S. Pat. No. 4,312,018), to provide a fluorescent or cold-cathode light source in an enclosure formed by a base plate and a concave cover. This assembly is secured releasably to a support which is secured to the wall or roof of the mine. Electrical connections are made between the base plate and the support for energizing the light bulb.

It is essential that the light source be protected from the ever-present dust and moisture of the mine. To this end a tight seal must be provided between the base plate and the cover or lens to prevent the entry of moisture and dust.

As a rule this cover or lens is held in place on the base plate by a plurality of screws which must be painstakingly withdrawn in order to gain access to the light tube in order to change it. Obviously this makes changing the light bulb relatively complex. Accordingly it has been suggested to make the entire lamp assembly removable so that the user need merely take off the burnt-out light bulb with its base plate and lens and replace it with another such unit which may be secured in place by means which do not have to make a hermetic seal between the support and the lamp assembly.

Since it is a relatively inconvenient operation, even at a work table outside the mine, to take part the lamp assembly, and put a new bulb into it, the above-described system has been found inadequate. Most often the lamp assemblies with burnt-out bulbs are simply discarded. Furthermore carting entire lamp assemblies down a mine and carting the lamp assemblies with burnt-out lamps back out is a procedure regarded by many mine operators as inefficient, compared to the ease with which fresh bulbs can be carried down, with the burnt-out light bulbs merely being discarded in the mine.

OBJECTS OF THE INVENTION

It is therefore an object of the present invention to provide an improved mine lamp.

Another object is to provide such a lamp whose bulb can be readily changed.

SUMMARY OF THE INVENTION

These objects are attained according to the instant invention and a lamp having a support to which is releasably secured a flat base plate which has an outer edge in a forwardly directed face. This outer edge is stepped and is formed with an annular abutment surface lying in a plane generally parallel to and offset backwardly from the face and an annular outwardly directed guide surface inclined at an angle to the abutment surface. A light tube is releasably supported on the base plate within the edge and in front of the face. A concave, at least partially transparent, and at least limitedly elastically deformable cover or lens has an end wall generally parallel to and offset forwardly from the face and a continuous annular side wall extending backwardly from the end wall and having an annular rear edge formed with an annular and generally planar surface engaging backwardly against the abutment surface and an annular retaining surface engaging inwardly against the guide surface. Thus there is continuous annular surface contact between the rear edge of the cover and the outer edge of the base plate. Means are provided including interengaging formations on the retaining and guide surfaces of the base plate and the cover for retaining the cover in place on the base plate with the rear edge in annular all-around contact with the outer edge. As a result the cover, which according to this invention is completely imperforate and continuous, can seal hermetically on the base plate. Entry of water or dust is therefore completely excluded.

With the system according to the instant invention it is therefore possible simply to snap the cover on or off so as to gain access to the tube which can readily be replaced, even without removing the base plate from the support. Changing the light tube is therefore a relatively easy job that can be done with no tools or with only a simple prying tool such as a screwdriver for separating the cover and the base plate.

According to further features of this invention the formations include recesses on one of the retaining and guide surfaces and bumps complementary to these recesses on the other of the retaining and guide surfaces. The bumps and recesses may be of generally part-circular or of generally sawtooth outline. With a sawtooth outline each of the bumps and recesses has a steep flank and a shallow flank, the shallow flank lying between the respective steep flank and the support. Thus the bumps and recesses serve to urge the rearwardly directed rear surface of the cover against the forwardly directed abutment surface of the base plate, ensuring a hermetic all-around seal in surface contact.

The interfitting bumps and recesses are substantially shorter than the respective surfaces. In fact only a few such bumps and recesses need be provided to securely hold the cover in place. Normally the support, base plate, tube, and cover are elongated and generally parallel. The side wall thus has a pair of long side-wall sections and a pair of short side-wall sections bridging the ends of the long side-wall sections. The bumps and recesses are provided only on the long side-wall sections, normally two or three on each one.

According to further features of this invention one of the edges is formed with at least one outwardly open notch so that a tool such as a screwdriver can be inserted into this notch to pry off the cover. This notch is normally formed in the abutment surface and does not create a point of leakage thanks to the surface contact between the guide and retaining surfaces.

The guide and abutment surfaces lie at an obtuse angle to each other and in fact the end wall and side wall lie at the same obtuse angle to each other. Thus the cover will grip the guide surface of the base plate and the retaining surface of the cover will be a simple continuation of the inner surface of the cover.

In accordance with further features of this invention the means for releasably securing the plate to the support includes at least one screw. This screw may have a head bearing against the cover at the end wall and a shank passing through the base plate and threaded into the support. Thus the screw not only secures the plate, cover, and tube to the support but also secures the cover on the plate. The base plate is normally formed with at least one forwardly directed spacer having a front end bearing against the end wall adjacent the screw. This spacer is normally tubular and surrounds the screw so that when the screw is tightened the cover is not deformed.

With the lamp according to the instant invention it is therefore a relatively simple manner to remove the entire light assembly constituted by the cover, base plate, light tube, and interconnecting means. Two screws, normally of the captive type, need merely be released to pull the whole assembly off. Then the electrical contacts can be disconnected in the manner described above in my earlier patent. Otherwise it is a relatively simple manner to snap the cover off the base plate and simply replace the bulb. When this is done a shorter screw can be used that merely secures the base plate to the support.

SPECIFIC DESCRIPTION

Figure 1:
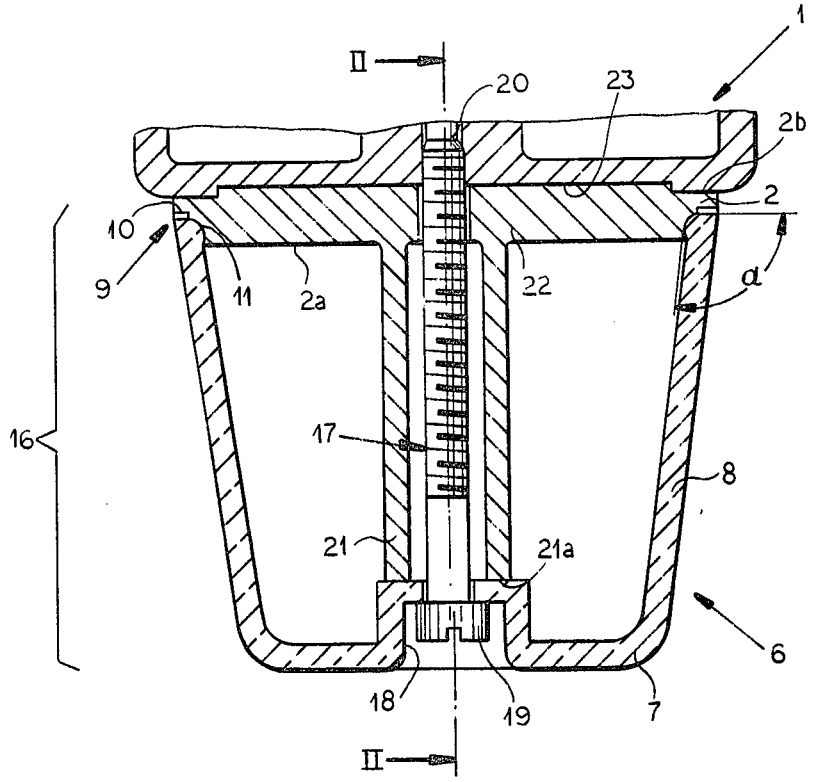
FIG. 1 is a cross section through a lamp according to this invention.
Figure 2:
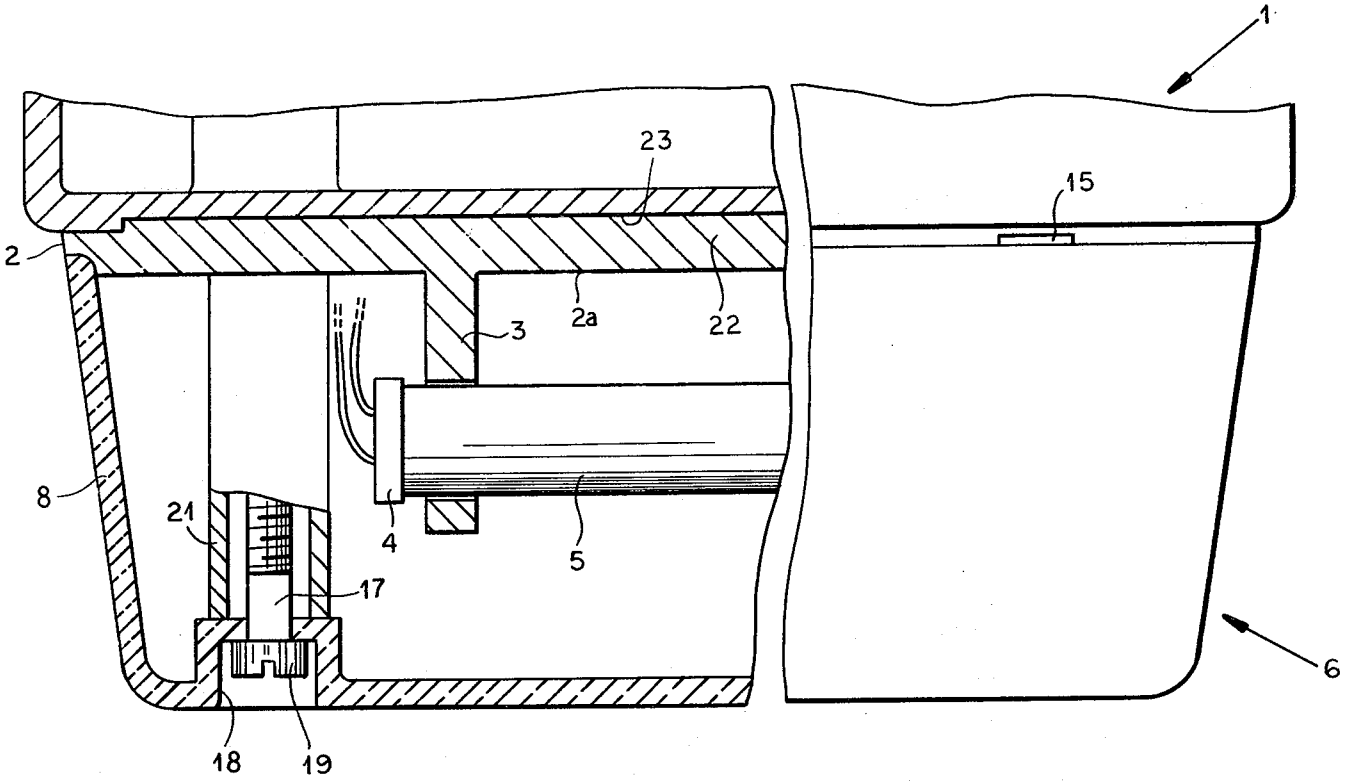
FIG. 2 is a longitudinal section taken along the line II—II of FIG. 1.

As seen in FIGS. 1 and 2, a mine lamp according to the instant invention has a support 1 normally secured to the wall or ceiling of a mine. A lamp base plate 2 is in turn secured to this support 1 and has a front face 2*a* from which extend two or more lugs 3 that receive a fluorescent or cold-cathode light tube 5 provided on its ends with connectors 4. These connectors 4 lead to conductors that extend through the base 2 and into the support 1 in the manner described in my above-cited copending application.

A synthetic-resin transparent cover 6 has a front end wall 7 parallel to the surface 2*a* and an annular side wall 8 secured to an outer edge 9 of the support plate 2. To this end the outer edge 9 is stepped so as to form an abutment surface 10 parallel to the surface 2*a* and a guide surface 11 lying at an obtuse angle a of about 110° to the planar annular surface 10.

The side wall 8 has an inner surface 8*a* forming at the edge 9 a retaining surface that lies flat against the surface 11. In addition the rear edge of the side wall 8 forms a planar annular surface 8*b* that lies flat against the surface 10. Surface 8*a* is formed along the long side-wall sections of the cover 6 with bumps 12 that fit into corresponding recesses 13 of the surface 11.

Figure 4:
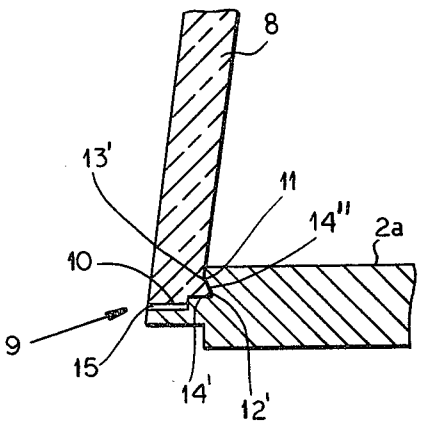
FIG. 4 is a view similar to FIG. 3 illustrating a variant of the instant invention.
Figure 3:
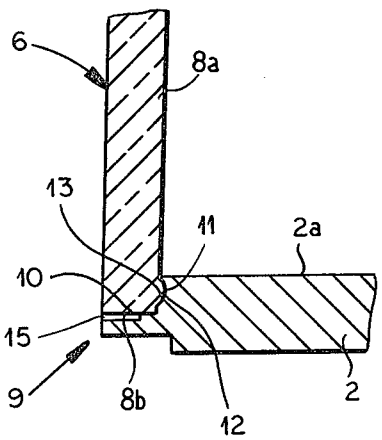
FIG. 3 is a large-scale view of a detail of FIG. 1.

As shown in FIG. 3 the bumps 12 and recesses 13 may be of complementary part-circular outline. They may also be formed as shown in FIG. 4 as sawtooth bumps and recesses 12' and 13'. In such an arrangement the steep flank 14' of the bump 13' and recess 12' lies backward of the shallow flank 14''. This insures that the elastic deformation of the side wall 8 will urge the surfaces 8*b* and 10 together.

Furthermore FIGS. 2, 3, and 4 show how notches 15 formed in the abutment surface 10 may be provided so that a screwdriver or the like can be inserted into the crack between the cover 6 and base plate 2 to allow them to be pried apart. This notch 15 has a depth measured parallel to the surface 2*a* which is less than the width of surface 10 so that it does not create a leak point.

The cover 6, base plate 2, bulb 5, and related structure constitute a bulb unit or assembly 16 held by means of screws 17 onto the support 1. To this end each of these screws 17 has a head 19 received in a counterbore 18 of the cover 6 and a threaded shank 20 passing through the base plate 2 and screwed into the support 1. The base plate 2 is integrally formed beyond each end of the light tube 5 with a tubular stop 21 having a front end surface 21*a* that lies flat against the inner surface of the cover 7 around the screw head 19. Thus even if the screw 17 is tightened greatly, the cover 6 will not be deformed so as to create a leak between it and the base plate 2. A longitudinally extending centering bump 22 formed on the rear surface 2*b* of the base plate 2 is received in a complementary recess 23 of the support 1 so that the assembly 16 can easily be centered before the screw 17 is inserted and tightened.

It is a relatively simple manner to replace the entire bulb assembly 16. The two screws 17 need merely be withdrawn to separate this assembly 16 from the support 1. The electrical conductors are disconnected and a new assembly 16 can be easily put in its place. Alternatively it is possible to use screws 17 which are substantially shorter than those shown in FIG. 1 so that their heads can bear directly on the front surface of the base plate 2 whereby these screws only secure the base plate 2 to the support 1. In that case a screwdriver inserted in the notch 15 can easily pop off the cover 6 for replacement of the bulb 4 alone.

I claim:

1. A lamp comprising:

a support;

a flat base plate having an outer edge and a forwardly directed face, said outer edge being formed with an annular abutment surface lying in a plane generally parallel to and offset backwardly from said face and an annular outwardly directed guide surface inclined at an obtuse angle to said abutment surface;

a light tube;

means for releasably supporting said tube on said base plate within said edge and in front of said face;

a concave, at least partially transparent, and at least limitedly elastically deformable cover having an end wall generally parallel to and offset forwardly of said face and a continuous annular side wall extending backwardly from and at said obtuse angle to said end wall and having an annular rear edge formed with an annular and generally planar surface engaging backwardly against said abutment surface and an annular retaining surface engaging inwardly against said guide surface;

means including interengaging formations on said retaining and guide surfaces for elastically retaining said cover in place on said base plate with said rear edge in annular all-around contact with said outer edge; and means for releasably securing said plate to said support with said face directed forwardly away from said support and including at least one screw having a head bearing against said cover at said end wall thereof and a shank passing through said base plate and threaded into said support.

2. The lamp defined in claim 1 wherein said one of said edges is formed with at least one outwardly open notch, whereby a tool such as a screwdriver can be inserted in said notch to pry off said cover.

3. The lamp defined in claim 2 wherein said notch is formed in said abutment surface.

4. The lamp defined in claim 1 wherein said formations include recesses on one of said retaining and guide surfaces and bumps complementary to said recesses on the other of said retaining and guide surfaces.

5. The lamp defined in claim 4 wherein said bumps and recesses are of generally part-circular outline.

6. The lamp defined in claim 4 wherein said bumps and recesses are substantially shorter than the respective surfaces.

7. The lamp defined in claim 4 wherein said support, base plate, tube, and cover are elongated and generally parallel, said side wall having a pair of long side-wall sections and a pair of short side-wall sections bridging the ends of said long side-wall sections, said bumps and recesses being provided only on said long side-wall sections.

8. The lamp defined in claim 4 wherein said bumps and recess are of generally sawtooth outline.

9. The lamp defined in claim 8 wherein said bumps and recesses each have a steep flank relatively close to said support and a shallow flank, said steep flanks lying between said support and the respective shallow flanks.

10. The lamp defined in claim 1 wherein said base plate is formed with at least one forwardly directed spacer having a front end bearing against said end wall adjacent said screw.

11. The lamp defined in claim 10 wherein said spacer is tubular and surrounds said screw.

12. The lamp defined in claim 11 wherein two such screws are provided, one at each end of said tube.

* * * * *